US005471280A

United States Patent [19]

Taguchi

[11] Patent Number: 5,471,280

[45] Date of Patent: Nov. 28, 1995

[54] ELECTROPHOTOGRAPHIC PRINTING APPARATUS HAVING AIR FLOW PASSAGE

[75] Inventor: Hironori Taguchi, Tosu, Japan

[73] Assignee: Matsushita Electric Industrial Co., Ltd., Osaka, Japan

[21] Appl. No.: 242,088

[22] Filed: May 12, 1994

[30] Foreign Application Priority Data

Jun. 3, 1993 [JP] Japan ..... 5-133125

[51] Int. Cl.[6] ..... G03G 21/20

[52] U.S. Cl. ..... 355/200; 355/30; 355/215

[58] Field of Search ..... 355/215, 30, 200, 355/210, 211, 219, 221, 282, 285; 219/216

[56] References Cited

U.S. PATENT DOCUMENTS

| | | | |
|---|---|---|---|
| 4,073,587 | 2/1978 | Selwyn | 355/30 X |
| 5,087,943 | 2/1992 | Creveling | 355/215 |
| 5,134,960 | 8/1992 | Shirai | 355/215 X |
| 5,187,525 | 2/1993 | Fushimi et al. | 355/215 X |
| 5,216,467 | 6/1993 | Esser et al. | 355/215 |
| 5,315,354 | 5/1994 | Mordenga | 355/215 X |

FOREIGN PATENT DOCUMENTS 3-61942 9/1991 Japan .

*Primary Examiner*—Robert Beatty

*Attorney, Agent, or Firm*—Stevens, Davis, Miller & Mosher

[57] ABSTRACT

A developing unit, an image-transfer unit and a fixing unit are located in that order in a vertically long housing from the bottom to the top of the housing, and a ventilation passage different from a sheet conveying passage, is formed having an inlet opening formed in the bottom part of the housing and the outlet opening formed in the top part of the housing and extending by way of the developing unit, the image-transfer unit and the fixing unit. Air in the ventilation passage is warmed up by extra heat from the fixing unit so as to induce an ascending air stream which expels NOx and ozone generated by corona discharge and which cools the fixing unit. With this arrangement, the necessity of a ventilating fan can be eliminated so as to miniaturize the electrophotographic printing apparatus and to reduce the cost while eliminating noise caused by a ventilating fan.

6 Claims, 3 Drawing Sheets

ELECTROPHOTOGRAPHIC PRINTING APPARATUS HAVING AIR FLOW PASSAGE

BACKGROUND OF THE INVENTION

1. Field of the Invention

The present invention relates to an electrophotographic printing apparatus comprising, in the inside of its housing, developing means, image transfer means and thermally fixing means.

2. Description of the Prior Art

These years, with the progress of the office automation for business equipment and machines, the demand of printers as terminal equipment of computers has been more and more increased. Inter alia, electrophotographic printing apparatuses such as laser printers which carry out nonimpact type printing have been rapidly spread in use because of low noise and a high printing quality.

Heretofore, such an electrophotographic printing apparatus uses a ventilating fan for forced ventilation of air outside of its housing in order to protect the apparatus against gas such as ozone or NOx produced through corona discharge by a developing means and an image transfer means so as to ensure the printing quality, and in order to radiate remaining heat from a thermally fixing means.

Explanation will be hereinbelow made of a conventional electrophotographic printing apparatus. Referring to FIG. 4 which is a sectional view illustrating an essential part of the conventional electrophotographic printing apparatus, a photosensitive medium drum 1 is electrified through corona discharge by a charger 2, and is then formed thereon with an electrostatic latent image by exposure light from an exposure unit 3. Thereafter, the electrostatic latent image is developed into a visual image with the use of toner by a developing unit 4. The visualized toner image is transferred, by an image transfer unit 5, onto a printing sheet 6 which has been fed from a paper feed part (which is not shown) in synchronization with the rotation of the photosensitive medium drum 1.

The printing sheet 6 on which the toner visualized image has been transferred is fed to a fixing part composed of a heating roller 7 and a pressing roller 8, and after fixing of the toner visualized image, the sheet 6 is discharged from a paper discharge part 16. Meanwhile, toner remaining on the outer surface of the photosensitive medium drum 1 after the image-transfer is removed therefrom by means of a cleaning blade 9, and then the photosensitive image 1 is deelectrified by a discharger 10 so as to have a uniform surface potential.

With the repetitions of the above-mentioned developing steps, several images are formed. The photosensitive medium drum 1, the charger 2, the image-transfer 5, and the fixing part composed of the heating roller 7 and the pressing roller 8, as mentioned above, are arranged, in general, horizontally within a housing 11.

Next explanation will be made of a ventilation system for the thus arranged electrophotographic printing apparatus. During the above-mentioned image formation, the charger 2 and the image transfer 5 using corona discharge produce gas such as ozone or NOx. Should the produced gas such as ozone or NOx be accumulated in the housing 11, the use lives of several components in the housing 11 and the printing quality would be detrimentally affected. Further, remaining and extra heat from the fixing part heats up several parts therearound, and accordingly, the use lives of the these parts and the printing quality are also detrimentally affected.

Accordingly, a ventilating passage 12 is formed communicating gas and heat sources to the outside of the housing, and a ventilating fan 14 for driving out the gas or the like is provided in the vicinity of a vent port. Thus, air streams A, B, C as indicated by the arrows are induced so that produced gas such as ozone or NOx and extra heat generated from the heating roller 7 in the fixing part are expelled outside of the housing 11. At this time, ozone generated from the charger 2 and the image transfer 5 is sucked up by the air streams A, B, and is then absorbed by an ozone absorbing filter 15 provided just before the ventilating fan 14. Further, the extra heat from the heating roller 7 is radiated outside of the housing 11 by the air stream B, C as indicated by the arrows.

However, the above-mentioned conventional electrophotographic printing apparatus using the ventilating fan 14 has raised many problems such that the ventilating fan 14 is expensive, and the miniaturization of the apparatus is limited because an extra space should be ensured for the attachment of the ventilating fan 14, and such that the ventilating fan 14 produces noise.

SUMMARY OF THE INVENTION

One object of the present invention is to provide an electrophotographic printing apparatus which is cheap and small-sized, and which produces less noise.

According to the present invention, there is provided an electrophotographic printing apparatus comprising a housing in which a developing part, an image transfer part and a fixing part are vertically arranged in that order from the bottom to the top of the housing, and a ventilation passage communicating among the developing part, the image-transfer part and the fixing part and opened at the top and the bottom of the housing.

With the above-mentioned arrangement, air heated up by extra heat from the fixing part produces an ascending air stream in the ventilation passage, and accordingly, gas such as ozone or NOx produced through corona discharge and extra heat are expelled outside of the housing by this ascending air stream.

As a result, the electrophotographic printing apparatus according to the present invention, can eliminate the necessity of the provision of ventilating fan so that the cost and the attachment space for the ventilating fan can be eliminated and that no operation noise of the ventilating fan is generated.

DESCRIPTION OF THE PREFERRED EMBODIMENTS

Figure 1:
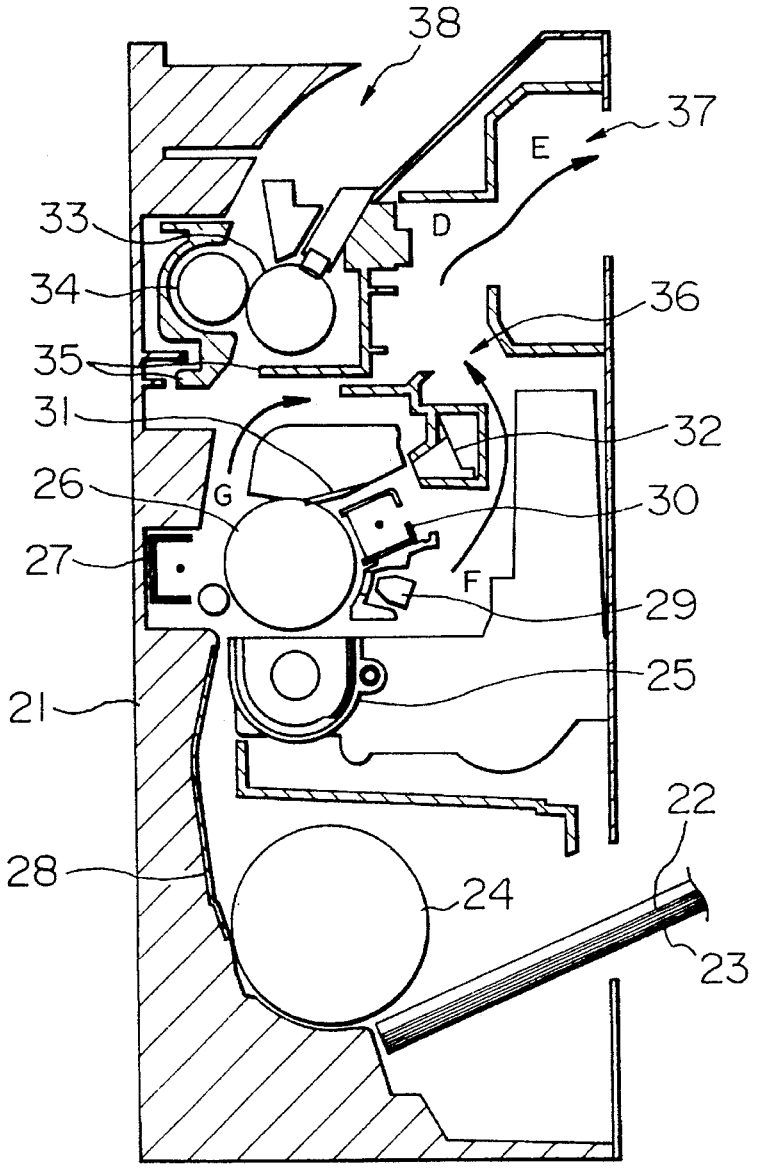
FIG. 1 is a sectional view illustrating an essential part of an electrophotographic printing apparatus in a first embodiment of the present invention.
Figure 4:
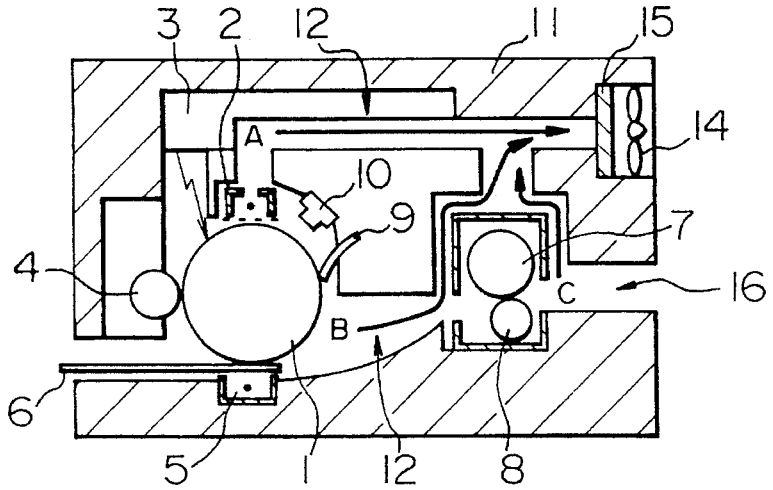
FIG. 4 PRIOR ART
FIG. 4 is a sectional view illustrating an essential part of a conventional electrophotographic printing apparatus.

Referring to FIG. 1 which is a sectional view illustrating an essential part of an electronic photographic printing apparatus in a first embodiment of the present invention, a vertically long housing 21 receives, at its bottom part, a cassette 23 in which printing sheets 22 are stacked and stored. A feed roller 24 is located in front of the cassette 23 received in the housing 21. When the feed roller 24 is rotated by a predetermined angle, the printing sheets 22 are led out one by one from the cassette 23 due to a frictional force given by the feed roller 24. Further, a guide part 28 is laid along the inner wall of the housing 21, along which the printing sheets 22 led out from the cassette 23 are conveyed upward.

A developing unit 25 is laid in the lower part of the housing 21, and a photosensitive medium drum 26 is located above the developing unit 25. Further, an image-transfer unit 27 lined with an ozone adsorbing material is provided on one side of the photosensitive medium drum 26. Further, an exposure unit 29 and a charger 30 lined with an ozone adsorbing material are located on the other side of the photosensitive medium drum 26. Further, a cleaning blade 31 and a discharger 32 are provided above the photosensitive medium drum 26. Further above the photosensitive medium drum 26, a heating roller 33 and a pressing roller 34 constituting a fixing part are located in the housing 21. A paper discharge passage 38 is formed above the fixing part.

As shown in FIG. 1, the developing unit 25, the photosensitive medium drum 26, the heating roller 33 and the pressing roller 34 are arranged, in general, vertically upward in that order within the vertically long housing 21, from the bottom to the top of the latter, and the heating roller 33 and the pressing roller 34 which are heated up to a highest temperature are arranged in the topmost part of the housing 23. A ventilation passage 36 is formed from the bottom to the top of the housing 21, communicating among the above-mentioned components. The ventilation passage 36 is communicated with the outside of the housing 21 through a loading port for the cassette 23, formed in the lower part of the housing 21, and a vent port 37 formed in the upper part of the housing 21. Reference marks D, E, F, G denote different parts of the ventilation passage 36.

Next, explanation will be hereinbelow made of the operation of the electrophotographic printing apparatus in the first embodiment of the present invention constituted as mentioned above.

The photosensitive medium drum 26 is electrified by the corona charge type charger 30 lined with the ozone adsorbing material, and then an electrostatic latent image is formed on the outer peripheral surface of the photosensitive medium drum 26 by the exposure unit 29. Then, the electrostatic latent image is turned into a visualized toner image by the developing unit 25. The visualized toner image is transferred from the outer peripheral surface of the photosensitive medium drum 26 onto a printing sheet 22 which has been fed from the cassette 23 in synchronization with the rotation of the photosensitive medium drum 26, by means of the corona discharge type image-transfer unit 27 lined with the ozone adsorbing material when the printing sheet 23 passes over the photosensitive medium drum 26.

The printing sheet 22 on which the visualized toner image has been transferred is fed into the fixing part composed of the heating roller 27 and the pressing roller 34 where the visualized toner image is fixed. After the fixing, the printing sheet 22 is discharged through the paper discharge passage 39.

Meanwhile, toner having not been transferred and remaining on the peripheral surface of the photosensitive medium drum 26 after the image-transfer, is then removed by the cleaning blade 31, and then the photosensitive medium drum 26 is deelectrified by the discharger 32 so as to have a uniform surface potential. Thereafter, the photosensitive medium drum 26 is electrified through the coronal discharge by the charger 30 for the next developing process in order to repeat the image formation.

Next, explanation will be made hereinbelow of the ventilation for the electrophotographic printing apparatus in the first embodiment of the present invention. In the progress of series of the image forming steps as mentioned above, gas such as NOx or unadsorbed and remaining ozone stagnates in the vicinity of the image-transfer unit 27 and the charger 30.

Upon fixing of the image, the heating roller 33 is heated up to a highest temperature. Accordingly, a case 35 is heated up by extra heat from the heating roller 33 up to a temperature of about 70 deg.C which has been confirmed by measurement. Air in the ventilation passage 36 in the vicinity of the part D, which passes over the rear surface of the case 35, is warmed up by the temperature of the case 35 up to a temperature of about 38 deg.C which has been confirmed by measurement. Due to the difference between the temperatures of the case 35 and the temperature of the air, an ascending air stream is induced from a position in the vicinity of the part D to a position in the vicinity of the part E.

The ascending air stream induced in the vicinity of the part D causes the air in the vicinity of the part D to become lean, and accordingly, the air in the ventilation passage 36 in the vicinity of the parts F, G (the temperature of which is about 30 deg. C, having been confirmed by measurement) ascends toward the part D. Thus, an air stream is induced as a whole from the loading port (the temperature of which is about 20 deg. C, having been confirmed by measurement) for the cassette 23 to the vent port 37 (the temperature of which is about 38 deg. C, being confirmed by measurement) as indicated by the arrow within the housing 21.

By such an air stream, gas such as NOx drifting around the image-transfer unit 27 and the charger 30 or ozone unadsorbed and remaining around the part D is vented upward through the ventilation passage 36. It is noted that air around the heating roller 33 and the pressing roller 34 is vented into a ventilation passage 38 from the paper discharge passage 36 in the vicinity of the part G through a slot in the case 35.

As explained above in detail, the electrophotographic printing apparatus in the first embodiment of the present invention, in which the developing part, the image-transfer part and the fixing part are arranged vertically as a whole in that order within the vertically long housing 21 from the bottom to the top of the latter, the fixing part whose temperature become highest being located topmost, and in which the ventilation passage 36 passing around these components is formed extending from the bottom to the top of the housing, uses an ascending air stream induced by air heated by extra heat from the fixing part so as to expel gas containing NOx and unadsorbed and remaining ozone outside of the housing together with the extra heat. Accordingly, the necessity of a ventilating fan can be eliminated; thereby it is possible to aim at miniaturizing the apparatus as a whole and at lowering the cost thereof, and further, to eliminate noise caused by a ventilating fan.

Figure 2:
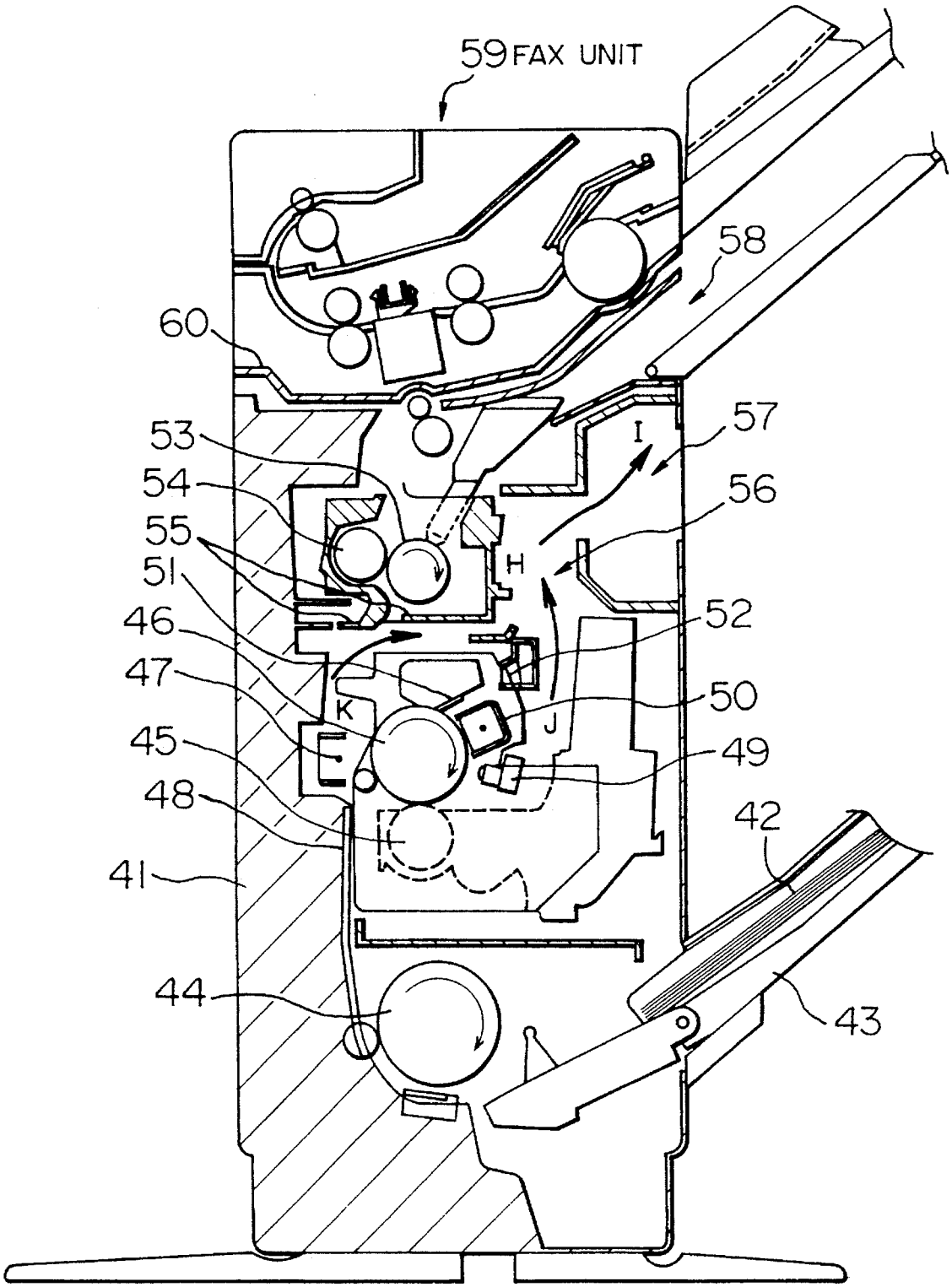
FIG. 2 is a sectional view illustrating an essential part of an electrophotographic printing apparatus incorporating a facsimile device, in a second embodiment of the present invention.

Referring to FIG. 2 which is a sectional view illustrating an essential part of an electrophotographic printing apparatus incorporating a facsimile device in a second embodiment of the present invention, a cassette 43 in which printing sheets 42 are stored and stacked is loaded in the bottom part of a vertically long housing 41. The printing sheets 42 are led out leftward from the cassette 43 by a frictional force of a paper feed roller 44 which is located in front of the cassette 43, when the feed roller 44 is rotated by a predetermined angle. Further, a guide part 48 is laid along the inner wall of the housing 41 so that the printing sheet 42 led out from the cassette 43 is conveyed along this guide part 48.

A developing unit 45 is located in the bottom part of the housing 41, and a photosensitive medium drum 46 is located above the developing unit 45. An image-transfer unit 47 lined with an ozone adsorbing material is provided on one side of the photosensitive medium drum 46. Further on other side of the photosensitive medium drum 46, there are provided an exposure unit 49 and a charger 50 lined with an ozone adsorbing material. Further, a cleaning blade 51 and a discharger 52 are provided above the photosensitive medium drum 46. A heating roller 53 and the pressing roller 54 which constitute a fixing part are provided in a case 55 further above the photosensitive medium drum 46. A paper discharge passage 58 is laid above the fixing part.

As shown in FIG. 2, the developing unit 45, the photosensitive medium drum 46, the heating roller 53 and the pressing roller 54 are arranged as a whole, vertically upward in that order within the vertically long housing 41 from the bottom to the top of the latter, the heating roller 53 and the pressing roller 54 which are heated up to a highest temperature being arranged in the topmost part of the housing, and a ventilation passage 56 communicating among these components is formed extending from the bottom to the top of the housing 41. The ventilation passage 56 is communicated with the outside of the housing 41 through a loading port for the cassette 43, formed in the bottom part of the housing 41, and also through a vent port 57 formed in the top part of one side surface of the housing 41. It is noted that reference marks H, I, J, K in the figure denote different parts in the ventilation passage 56.

Further, a facsimile unit 59 having a facsimile manipulating panel and a document reader which are integrally incorporated with each other is mounted in the topmost part of the housing 41 which is partitioned by a partition wall 60 so as to facilitate the manipulation of the facsimile unit by the user. That is, upon receiving a facsimile, the electrophotographic printing apparatus is operated in accordance with a received signal.

Next, explanation will be hereinbelow made of the above-mentioned electrophotographic printing apparatus in the second embodiment of the present invention. It is noted that the printing process and the generation of gas during the image forming operation, are identical with those explained in the first embodiment, and accordingly, the explanation thereof will be omitted in order to avoid redundancy.

During fixing of an image, the heating roller 53 is heated up to a highest temperature. Accordingly, extra heat from the heating roller 53 heats up a case 55. Air in the ventilation passage 56 in the vicinity of the part H, passing over the rear surface of the case 55 is warmed up by the temperature of the case 55, and accordingly, an ascending air stream is generated from a position in the vicinity of the part H to a position in the vicinity of the part I as indicated by the arrows.

Thus, the generation of the ascending air stream causes the air around the part H to become lean so that air in the ventilation passage 56 in the vicinity of the parts J, K ascends toward the part H, and accordingly, an air stream is produced as a whole in the housing 41 from the loading port for the cassette 43 to the vent port 57, as indicated by the arrows.

With this air stream, gas such as NOx drifting around the image-transfer unit and the charger 50 or unadsorbed and remaining ozone is vented upward through the ventilation passage 56. It is noted that air around the heating roller 53 and the pressing roller 54 is vented into the paper discharge passage 58 from the ventilation passage 56 in the vicinity of the part K through a slot in the case 55. Since the facsimile unit 59 is isolated by the partition wall 60, it can be prevented from being affected by the gas and the heat.

As mentioned above, the electrophotographic printing apparatus incorporating a facsimile device in the second embodiment of the present invention in which the developing part, the image-transfer part and the fixing part are arranged in that order in the vertically long housing, in general, vertically from the bottom to the top of the housing, the fixing part whose temperature becomes highest being located the topmost of the housing, and in which the ventilation passage 56 passing over these components is formed extending from the bottom to the top of the housing, uses an ascending air stream which is induced by air heated up by extra heat from the fixing part, so as to expel gas containing the NOx and unadsorbed and remaining ozone outside of the housing together with the extra heat. Accordingly, the necessity of a ventilating fan can be eliminated; thereby it is possible to aim at miniaturizing the apparatus as a whole and at reducing the cost thereof, and to eliminate noise caused by a ventilating fan.

Figure 3:
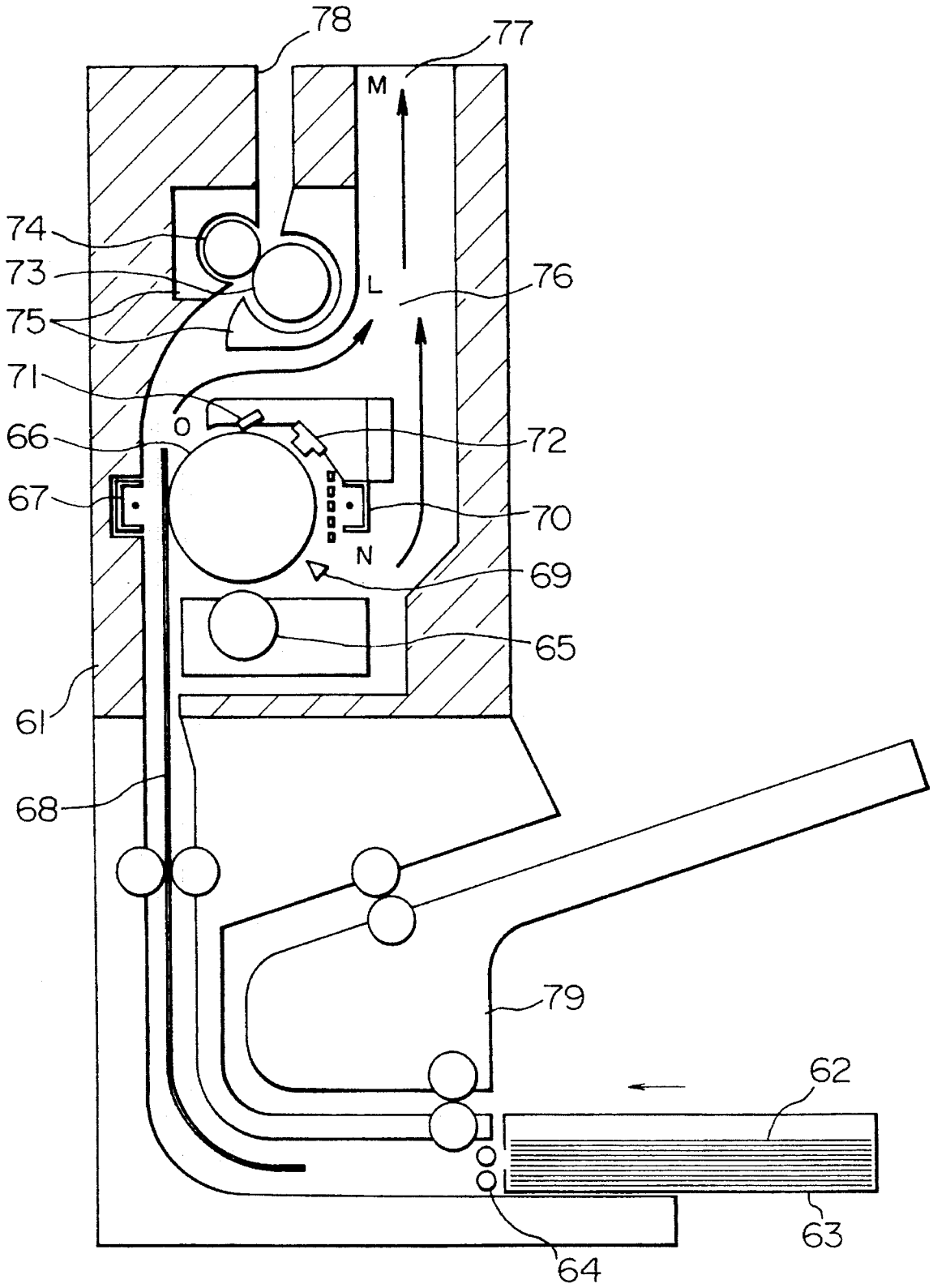
FIG. 3 is a sectional view illustrating an essential part of an electrophotographic printing apparatus in another embodiment of the present invention.

Referring to FIG. 3 which is a sectional view illustrating an essential part of an electrophotographic printing apparatus incorporating a scanner in a third embodiment of the present invention, a cassette 63 in which printing sheets 62 are stored and stacked is loaded in the bottom part of a vertically housing 61. A pair of upper and lower feed rollers 64 are located in front of the cassette 63, and accordingly the printing sheets 62 are led out one by one leftward from the cassette 63 by a frictional force given by the pair of feed rollers 64. Further, a guide 68 is laid along the inner wall of the housing 61, and accordingly, the printing sheets 62 led out from the cassette 63 are conveyed upward along the guide 68.

A developing unit 65 is located in the bottom part of the housing 61, and a photosensitive medium drum 66 is located above the developing unit 65. An image-transfer unit 67 is lined with an ozone adsorbing material is provided on one side of the photosensitive medium drum 66. On the other side of the photosensitive medium drum 66, there are provided an exposure unit 69 and a charger 70 lined with an ozone adsorbing material. A cleaning blade 71 and a discharger 72 are provided above the photosensitive medium drum 66. Further above the photosensitive medium drum 66, a heating roller 73 and a pressing roller 74 constituting a fixing part are provided in a case 75. A paper discharge passage 78 is formed above the fixing part.

As shown in FIG. 3, the developing unit 65, the photosensitive medium drum 66, the heating roller 73 and the pressing roller 74 are arranged vertically upward in that order, substantially in the vertical direction within the housing 61, from the bottom to the top of the latter, the heating roller 73 and the pressing roller 74 which are heated up to a highest temperature being located in the topmost part of the housing 61, and a ventilation passage 76 communicating among these components is formed vertically from the bottom to the top of the housing. The ventilation passage 76 is communicated with the outside of the housing 61 through a loading port for the cassette 63, formed in the bottom part of the housing, and through a vent port 77 formed in the top part of one side surface of the housing 61. It is noted that reference marks L, M, N, O in the figure denote different parts in the ventilation passage 76.

Further, a scanner unit 79 in which the manipulation panel of a scanner is integrally incorporated with a document reader is mounted in one side surface of the lower part of the housing 61, being isolated by a partition wall, so as to facilitate the manipulation of the scanner unit by the operator. That is, when an image read by the scanner is transferred, the electrophotographic printing apparatus is operated in response to a signal from the scanner unit 79.

Next explanation will be hereinbelow made of the above-mentioned electrophotographic printing apparatus in the third embodiment of the present invention, It is noted that the printing process and the generation of gas during the image forming process are identical with those explained in the first embodiment, and accordingly, the explanation thereof will be omitted in order to avoid redundancy.

During fixing of an image, the heating roller 73 is heated up to a highest temperature. Accordingly, extra heat from the heating roller 73 heats up the case 75. Air in the ventilation passage 76 in the vicinity of the part L, passing over the rear surface of the case 75, is warmed up by the temperature of the case 75, and accordingly, an ascending air stream from a position in the vicinity of the part L to a position in the vicinity of the part M is induced as indicated by the arrows.

The generation of the ascending air stream around the part L causes the air around the part L to become lean, and accordingly, air in the ventilation passage 76 around the parts N, O ascends toward a position around the part L, and accordingly, an air stream is induced, as a whole, extending from the loading port for the cassette to the vent port 77, as indicated by the arrows.

With this air stream, gas such as NOx drifting around the image-transfer unit 67 and the charger 70 or unadsorbed and remaining ozone is vented upward through the ventilation passage 76. It is noted that air around the heating roller 73 and the pressing roller 74 is vented into a paper discharge passage 58 from the ventilation passage 76 in the vicinity of the part O through a slot in the case 75.

As mentioned above, the electrophotographic printing apparatus incorporating the scanner in the third embodiment of the present invention in which the developing part, the image-transfer part and fixing part are arranged in that order in a substantially vertical direction from the bottom to the top of the vertically long housing 61, the fixing part whose temperatures becomes highest being located in the topmost part of the housing, and in which the ventilation passage 76 passing over these components is formed vertically from the bottom to the top of the housing, uses an ascending air stream which is induced by air warmed up by extra heat from the fixing part, so as to expel gas containing NOx and unadsorbed and remaining ozone outside of the housing together with the extra heat. Accordingly, the necessity of a ventilating fan is eliminated, thereby it is possible to aim at miniaturizing the apparatus as a whole, and at reducing the cost thereof, and to eliminate noise caused by a ventilating fan.

What is claimed is:

1. An electrophotographic printing apparatus comprising:

a vertically long housing forming an exterior of said apparatus and having a top part formed therein with a first opening, and a bottom part formed therein with a second opening;

a first unit exhibiting a temperature higher than a temperature of an atmosphere surrounding said housing in an operating condition, and located in said housing;

a second unit exhibiting a temperature lower than said temperature of said first unit and producing gas in the operating condition and located in said housing substantially vertically below said first unit;

an air flow passage means for leading an air stream from said second opening to said first opening by way of said second and first units, whereby an air stream is induced in said air flow passage due to a difference in temperature between said first and second units; and a sheet conveying means including a sheet conveying path which is different from a path of said air stream.

2. A thermally fixing type electrophotographic printing apparatus comprising:

a vertically long housing forming an exterior of said apparatus and having a top part formed therein with a first opening, and a bottom part formed therein with a second opening;

a thermally fixing means exhibiting a temperature higher than a temperature of an atmosphere surrounding said housing in an operating condition, and located in said housing;

an image transfer unit including a corona-discharge means and exhibiting a temperature lower than the temperature of said fixing means, producing gas in the operating condition, and located in said housing substantially vertically below said thermally fixing means;

an air flow passage leading an air stream induced by a difference in temperature between said thermally fixing means and a space below said thermally fixing means in said housing, from said second opening to said first opening by way of said corona-discharge means and said thermally fixing means, whereby an air stream is induced in said air flow passage due to a difference in temperature between said thermally fixing means and said corona discharge means, for cooling said thermally fixing means and for ventilating said corona-discharge means; and a sheet conveying means including a sheet conveying path which is different from a path of said air stream.

3. An electrophotographic printing apparatus as set forth in claim 2, wherein said thermally heating means comprises a heating roller.

4. An electrophotographic printing apparatus as set forth in claim 2, wherein said gas is air containing nitrogen oxides and ozone.

5. A thermally fixing type electrophotographic printing apparatus as set forth in claim 2, further comprising a facsimile device located in said top part of said housing and isolated from said air stream.

6. A thermally fixing type electrophotographic printing apparatus as set forth in claim 2, further comprising an image scanner device located in a lower-most part of said housing.

* * * * *